United States Patent [19]

Ramos

[11] Patent Number: 4,819,278

[45] Date of Patent: Apr. 11, 1989

[54] INVALID COMMODE SUPPORT APPARATUS

[76] Inventor: Francisca Ramos, 40 Sharp St., Haverstraw, N.Y. 10927

[21] Appl. No.: 163,306

[22] Filed: Mar. 2, 1988

[51] Int. Cl.[4] ..... A47C 7/36

[52] U.S. Cl. ..... 4/254; 280/304.1; 297/468

[58] Field of Search ..... 4/254; 297/417, 464, 297/466, 485, 468, 469; 5/431, 432, 433, 434, 436, 437, 508; 280/289 WC

[56] References Cited

U.S. PATENT DOCUMENTS

| | | | |
|---|---|---|---|
| D. 179,394 | 12/1956 | Mills . | |
| 1,038,388 | 9/1912 | Kiessig | 4/254 |
| 1,638,040 | 8/1927 | Killen . | |
| 1,731,709 | 10/1929 | Cropsey | 297/417 |
| 2,582,321 | 1/1952 | Farrell . | |
| 3,263,245 | 8/1966 | Ettinger . | |
| 3,977,028 | 8/1976 | Chang . | |
| 4,510,631 | 4/1985 | Grady . | |

FOREIGN PATENT DOCUMENTS

| | | | |
|---|---|---|---|
| 447993 | 11/1948 | Italy | 4/254 |

*Primary Examiner*—Henry J. Recla
*Assistant Examiner*—Robert Fetsuga
*Attorney, Agent, or Firm*—Leon Gilden

[57] ABSTRACT

An invalid commode support apparatus is set forth wherein a neck support, either integrally secured to or separate from an associate back support, are each securable to an upright plumbing supply, as utilized in commercial commode devices, such as in hospitals. A plurality of Velcro securement straps are securable about an individual utilizing the apparatus wherein optionally employable pivotal arms are secured at either side of the aforenoted back rest portion of the apparatus.

8 Claims, 1 Drawing Sheet

INVALID COMMODE SUPPORT APPARATUS

BACKGROUND OF THE INVENTION

1. Field of the Invention

The field of invention relates to a commode support apparatus and more particularly relates to a new and improved commode support apparatus for use in conjunction with hospital-type commodes utilizing an extended water supply conduit for securement of the invention thereto.

2. Description of the Prior Art

The use of commode support and securement devices is well known in the prior art. As may be appreciated, these devices have normally been of expansive and unnecessarily complex organization or have been inadequate to provide the necessary support for invalids such as stroke victims that require multiple support in the regular use of a commode facility. In this connection, there have been several attempts to develop commode securement and support devices which may be easily and efficiently utilized when desired. For example, U.S. Pat. No. 1,638,040 to Killen sets forth an invalid toilet chair that is rotatably positionable over a commode wherein a conventional type chair organization has an opening formed medially thereof enabling use of said chair by an individual of diminished physical capacity. The Killen patent while of assistance in providing support to an invalid-type individual, fails to provide the necessary support and particularly a cushioned support with associated securement devices for the appropriate positioning of such an individual in using a commode facility.

U.S. Pat. No. 3,977,028 to Chang provides an associated back rest in combination with a conventional commode to enable enhanced back and neck support of an individual, but as in other prior art devices, fails to provide adequate support and particularly a cushioned support in combination with a plurality of securement straps to appropriately position an invalid to a commode.

U.S. Pat. No. 2,582,321 to Farrell provides a back rest for toilet seats that merely provides extended lateral support to an existing toilet seat but fails to provide necessary back, arm, and securement devices for use with invalids and others of diminished physical capacity such as stroke victims.

U.S. Pat. No. 3,263,245 to Ettinger provides an additional back support attachment for toilet seats wherein a somewhat contoured back rest is secured to a conventional toilet seat to provide additional lateral support and comfort but as in the other prior art devices, is relatively remote from the instant invention in failing to provide the necessary neck and upper back support in cooperation with a plurality of securement straps.

U.S. Pat. No. 4,510,631 to Grady provides a portable commode formed with a plurality of wheels to effect a mobile structure including a restraining bar to span a seat area to maintain a use in position but while an effective mobile-type chair, does not provide the necessary extended neck and back support and securement apparatus as does the instant invention.

U.S. Pat. No. Des. 179,394 to Mills provides a framework associatable with a conventional commode to provide somewhat additional support apparatus but is of relatively remote organization and function to the instant invention.

As such, it may be appreciated that there is a continuing need for a new and improved invalid commode support apparatus which addresses both the problem of comfort and effectiveness and in this respect, the present invention substantially fulfills this need.

SUMMARY OF THE INVENTION

In view of the foregoing disadvantages inherent in the known types of invalid commode support apparatus now present in the prior art, the present invention provides an invalid commode support apparatus wherein the same may be effectively and readily associated with an existing hospital-type commode and may be easily and efficiently secured to a user when desired. As such, the general purpose of the present invention, which will be described subsequently in greater detail, is to provide a new and improved invalid commode support apparatus which has all the advantages of the prior art commodes support apparatus and none of the disadvantages.

To attain this, the present invention comprises an invalid commode support apparatus which may be readily and efficiently secured to an upstanding stanchion of an associated commercial-type commode such as utilized in hospitals. A plurality of clamps secured to a back rest portion is securable to said stanchion and, an integrally secured or separate neck rest portion is also secured to the same stanchion. The various support portions are padded for comfort wherein the back support portion includes a plurality of Velcro engageable straps for securement of a user thereto with the additional optional employment of a plurality of arm rests secured to said back support portion.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved invalid commode support apparatus which has all the advantages of the prior art invalid commode support apparatus and none of the disadvantages.

It is another object of the present invention to provide a new and improved invalid commode support apparatus which may be easily and efficiently manufactured and marketed.

It is a further object of the present invention to provide a new and improved invalid commode support apparatus which is of a durable and reliable construction.

An even further object of the present invention is to provide a new and improved invalid commode support apparatus which is susceptible of a low cost of manufacture with regard to both materials and labor, and which accordingly is then susceptible of low prices of sale to the consuming public, thereby making such invalid commode support apparatus economically available to the buying public.

Still yet another object of the present invention is to provide a new and improved invalid commode support apparatus which provides in the apparatuses and methods of the prior art some of the advantages thereof, while simultaneously overcoming some of the disadvantages normally associated therewith.

Still another object of the present invention is to provide a new and improved invalid commode support apparatus wherein a neck and back support portion are formed either separately or integrally secured together and are padded for comfort of a user.

Even still another object of the present invention is to provide a new and improved invalid commode support apparatus wherein a plurality of securement straps including Velcro fastening means are associated with a back support portion for the securement of an individual thereto.

Yet another object of the present invention is to provide a new and improved invalid commode support apparatus wherein a plurality of optionally employable pivotal arm rests are secured to a back rest portion for use with individuals, as is deemed necessary.

These together with other objects of the invention, along with the various features of novelty which characterize the invention, are pointed out with particularity in the claims annexed to and forming a part of this disclosure. For a better understanding of the invention, its operating advantages and the specific objects attained by its uses reference should be had to the accompanying drawings and descriptive matter in which there is illustrated preferred embodiments of the invention.

BRIEF DESCRIPTION OF THE DRAWINGS

The invention will be better understood and objects other than those se forth above will become apparent when consideration is given to the following detailed description thereof. Such description makes reference to the annexed drawings wherein.

DESCRIPTION OF THE PREFERRED EMBODIMENT

Figure 1:
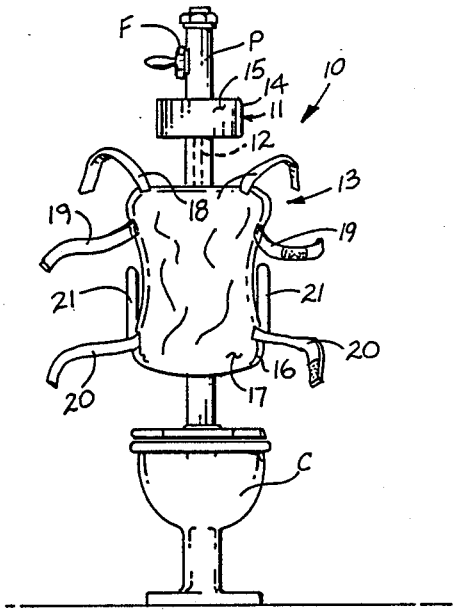
FIG. 1 is an orthographic view taken in elevation of the instant invention secured to a commercial commode organization.
Figure 2:
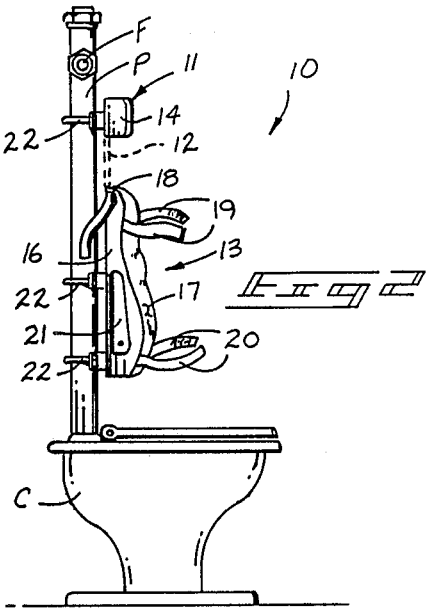
FIG. 2 is a side orthographic view taken in elevation of the instant invention secured to a hospital commode organization.

With reference now to the drawings, and in particular to FIGS. 1 to 7 thereof, a new and improved invalid commode support apparatus embodying the principles and concepts of the present invention and generally designated by the reference numeral 10 will be described.

More specifically, it will be noted that the invalid commode support apparatus 10 essentially comprises a neck support portion 11 and a concave back support portion 13 secured to a stanchion pipe "P" of a conventional commercial-type commode "C" formed with an overlying flush valve "F", as is typically utilized in a hospital environment, for example. An optional bridge member 12 is illustrated in use in FIGS. 1 and 2 and may integrally secure the neck and back support portions together, if desired, but preferably the neck and back support portions 11 and 12 respectively are separately securable to the associated stanchion pipe "P" to enable a wider range or accommodation of varying and anatomical configurations of individuals.

The neck support portion 11 includes a concave neck support shell with an included neck support padding 15 thereon to enhance comfort of a user secured thereto.

Figure 7:
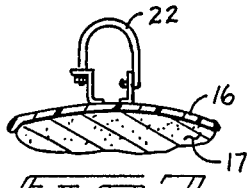
FIG. 7 is an orthographic view taken on the lines 7—7 of FIG. 6 in the direction indicated by the arrows.

Back support portion 13 is formed of a generally figure eight configuration to anatomically complement the human physiology wherein a greater degree of lateral lower lumbar support is illustrated in the lower portion of back support portion 18 with a narrowed mid portion and an expanded upper back support portion to effect a greater degree of relative comfort to an individual. The back support portion is formed of a back support shell 16 with back support padding 17 formed thereto, as illustrated in FIG. 7.

Figure 3:
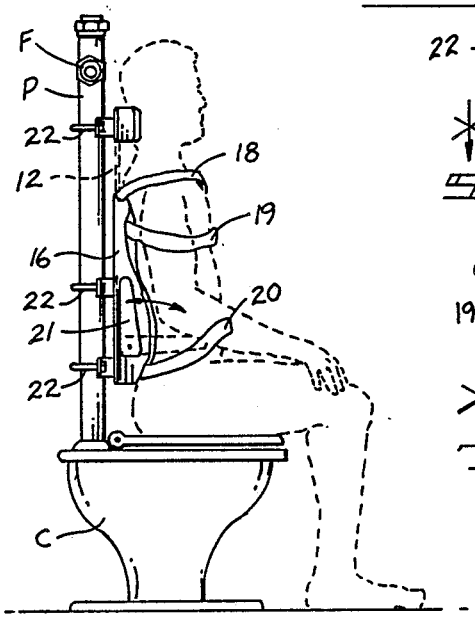
FIG. 3 is an orthographic side view taken in elevation of the instant invention illustrating (in phantom) a user secured thereto.
Figure 4:
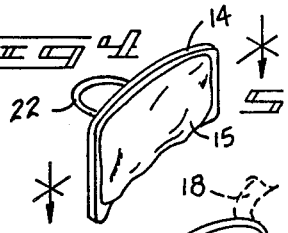
FIG. 4 is an isometric illustration of a neck rest of the instant invention.

A plurality of securement straps are utilized in conjunction with the back support portion. A shoulder strap pair 18 is formed in an upper portion of the support 18 with a torso strap pair 19 positioned somewhat medially to the support 13 with an underlying waist support pair 20 secured at the lowermost portion thereof for association with an individual's waist area, as illustrated in FIG. 3. Also secured to the back support portion 18 are a plurality of pivotally associated arm rests 21 to enable their employment, if desired, with a certain variety of individuals, such as stroke patients that may require the use of such arm rests for comfort and convenience of the commode facility.

Figure 5:
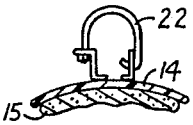
FIG. 5 is an orthographic view taken along the lines 5—5 of FIG. 4 in the direction indicated by the arrows.
Figure 6:
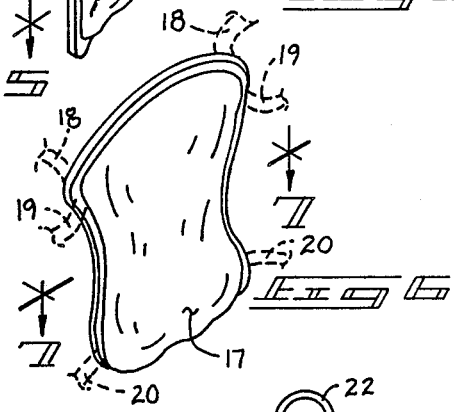
FIG. 6 is an isometric illustration of the back rest portion of the instant invention.

A single encircling clamp 22 is utilized in conjunction with the neck support portion 11, as illustrated in FIG. 5, and associated with the stanchion pipe "P" whereas the back support portion 13 utilizes a plurality of encircling clamps 22 for stable securement of the back support portion 13 to the stanchion pipe "P". It should be noted that the use of Velcro fasteners are utilized in association with the various strap pairs 18, 19, and 20 respectively for ease of releasable securement of the pairs in securement of an individual to the apparatus 10.

As to the manner of usage and operation of the present invention, the same should be apparent from the above description. Accordingly, no further discussion relative the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and descried, and accordingly, all suitable modifications and equivalents may be resorted to, falling within the scope of the invention.

What is claimed as being new and desired to be protected by Letters Patent of the United States is as follows:

1. An invalid commode support apparatus for use in combination with a commode including an elongate stanchion pipe vertically extending from said commode wherein said apparatus comprises, a neck support including means for clampingly engaging said neck support to said stanchion pipe and for complementarily accepting a human neck positioned thereon; and a back support connected to said neck support and including means for clampingly securing said back support to said stanchion pipe and underlying said neck support;

said back support further including a plurality of inter-engaging securement paired means for securement of an individual to said back support.

2. An invalid commode support apparatus as set forth in claim 1 wherein said neck support is of an arcuate configuration with padding secured thereon.

3. An invalid commode support apparatus as set forth in claim 2 wherein said back support is of a generally figure eight concave configuration anatomically complementing a human shape wherein a lower portion of said back support is of a generally wider configuration to support a lower lumbar region of the human anatomy and of a somewhat narrower mid portion and of a wider upper back region.

4. An invalid commode support apparatus as set forth in claim 3 wherein said back support further includes padding secured thereto.

5. An invalid commode support apparatus as set forth in claim 4 wherein said neck support and said back support are integrally secured together by a bridge member.

6. An invalid commode support apparatus as set forth in claim 4 wherein said means for engaging is formed with an individual encircling clamp for securement to said stanchion pipe and said means for securing is formed with a plurality of encircling clamps for securement to said stanchion pipe.

7. An invalid commode support apparatus as set forth in claim 6 wherein said securing means comprise three pairs of securement straps with Velcro fastening portions at the terminal ends for rapid association and disassociation of said strap pairs.

8. An invalid commode support apparatus as set forth in claim 7 wherein said back support further includes a plurality of pivotal arm rests secured to the sides of said back support for rotation from a first position parallel to said stanchion pipe to a second position generally orthogonal to said stanchion pipe.

* * * * *